US012318654B2

(12) United States Patent
Berg

(10) Patent No.: US 12,318,654 B2
(45) Date of Patent: Jun. 3, 2025

(54) EXERCISE HANDLE APPARATUS

(71) Applicant: Sondre Johan Kjellin Berg, Oslo (NO)

(72) Inventor: Sondre Johan Kjellin Berg, Oslo (NO)

( * ) Notice: Subject to any disclaimer, the term of this patent is extended or adjusted under 35 U.S.C. 154(b) by 145 days.

(21) Appl. No.: 18/201,249

(22) Filed: May 24, 2023

(65) Prior Publication Data

US 2024/0390727 A1 Nov. 28, 2024

(51) Int. Cl.
*A63B 21/00* (2006.01)
*A63B 21/068* (2006.01)

(52) U.S. Cl.
CPC ..... *A63B 21/4035* (2015.10); *A63B 21/068* (2013.01)

(58) Field of Classification Search
CPC ..... A63B 7/00; A63B 7/02; A63B 21/00185; A63B 21/068; A63B 21/151; A63B 21/16; A63B 21/4035; A63B 21/4039; A63B 23/1209; A63B 23/1218; A63B 23/1227; A63B 23/1236; A63B 2208/0285; A63B 2208/029; A63B 2210/50; A63B 2225/09; A63B 2244/12
See application file for complete search history.

(56) References Cited

U.S. PATENT DOCUMENTS 4,921,245 A * 5/1990 Roberts ..... A63B 7/02 482/42
9,986,790 B2 * 6/2018 Ness ..... A44B 11/04
2006/0063652 A1 * 3/2006 Berman ..... A63B 21/153 482/126
2012/0329618 A1 * 12/2012 White ..... A63B 21/0552 482/126
2012/0329620 A1 * 12/2012 White ..... A63B 23/1236 482/131
2015/0126334 A1 * 5/2015 Newman ..... A63B 21/4039 482/24
2016/0045789 A1 * 2/2016 Byers ..... A63B 47/00 206/315.9
2018/0140894 A1 * 5/2018 Ross ..... A63B 21/08
2019/0240529 A1 * 8/2019 Burkinshaw ..... A63B 21/4043
2020/0086172 A1 * 3/2020 Tarkington ..... A63B 21/022
2020/0338381 A1 * 10/2020 Amoroso ..... A63B 21/4035
2021/0361999 A1 * 11/2021 Tarkington ..... A63B 21/4047
2022/0134160 A1 * 5/2022 Li ..... A63B 7/02 482/24

FOREIGN PATENT DOCUMENTS

AU 727828 B3 * 1/2001
AU 2007231761 A1 * 5/2008 ..... A63B 21/023
DE 202022101851 U1 * 6/2022
DE 102022117522 B3 * 11/2023

* cited by examiner

*Primary Examiner* — Gary D Urbiel Goldner

(57) ABSTRACT

An arc-shaped exercise handle apparatus provides a more compact, easily adjustable, and comfortable alternative to traditional gym rings. The apparatus, shaped as a third of a classic gymnastics ring, comprises tunnels at each end through which a rope or strap is threaded and looped around webbing, attached to an anchor point. The webbing is equipped with G-hooks, facilitating easy length adjustment. The handle ends feature parallel flattened surfaces, enabling the apparatus to stand upright on a surface for certain exercises. Grooves running perpendicularly to the tunnels hold the portions of the rope that protrude from the openings, reducing friction against the user's arms.

11 Claims, 4 Drawing Sheets

EXERCISE HANDLE APPARATUS

FIELD OF INVENTION

The present invention relates generally to the field of physical exercise equipment, and more specifically to an apparatus that emulates the functionality of traditional gym rings while introducing significant improvements in portability, adjustability, and ergonomic design.

BACKGROUND

Gymnastics rings or gym rings have been a staple in both professional and personal fitness regimes for many years. Traditionally, these rings are suspended from a ceiling or support structure by adjustable straps or webbing. Users engage in a wide range of exercises, using their body weight for resistance and the rings for support and stability. Despite their simplicity and effectiveness, gym rings present certain drawbacks that limit their utility and usability.

One major disadvantage of traditional gym rings is their bulky size and weight. These characteristics often make the rings inconvenient to transport and store, and they consume a considerable amount of material to manufacture. This issue has been a barrier to people who wish to maintain a flexible fitness routine at different locations, such as at home, in a park, or while travelling.

Another drawback lies in the complexity of adjusting the gym rings. Gym rings typically involve a substantial amount of excess webbing that needs to be wrapped and held by Velcro or similar fastening devices. Users who wish to adjust the length of the webbing to suit different exercises or users of different heights must detach and then rewrap the webbing each time, a process that can be time-consuming and inconvenient.

Moreover, traditional gym rings are circular and do not offer a variety of grip options. As users undertake advanced training exercises, there is a need for handles that provide a comfortable grip and can facilitate more advanced ring skills. Additionally, the full-circle design of traditional gym rings often causes the attached straps or ropes to rub against the users' forearms, causing discomfort or even injuries during more complex exercises.

Furthermore, the handling and management of the excess webbing can be problematic, with no streamlined or integrated solutions available for storing the webbing when not in use or during transportation. This, in turn, can lead to a messy workout area and can hinder the exercise process.

Lastly, traditional gym rings and their supporting webbing are often made from plastic or other non-organic materials. Given the increasing global awareness of the environmental impact of plastic use, a desire for gym equipment made from sustainable, eco-friendly materials has been growing.

Accordingly, there exists a need for an improved gym ring apparatus that addresses the above-mentioned shortcomings. An optimal solution should offer enhanced portability, easy adjustability, a more comfortable and versatile grip, and an environmentally friendly design.

It is within this context that the present invention is provided.

SUMMARY

The present invention provides a solution to the challenges faced with traditional gym rings by offering an arc-shaped exercise handle apparatus that is more compact, portable, and easily adjustable while ensuring enhanced user comfort and versatility. The apparatus has a rounded cross-section, constituting one third of a conventional gymnastics ring, with an inner radius identical to that of a standard gymnastics ring.

In one embodiment of the invention, the arc-shaped exercise handle features two tunnels, one at each end. A rope or strap can be threaded through these tunnels and wrapped around a piece of webbing that is affixed to an anchor point, thereby suspending the handle from the webbing. The webbing is equipped with G-hooks which can be used to secure the webbing around an anchor point and conveniently adjust the length of the loop formed by the webbing, hence altering the distance from the exercise handle to the anchor point.

The design of the handle ends incorporates parallel flattened surfaces, allowing the handle to be placed upright on a surface, providing stability and utility during specific exercises. To enhance comfort during workout sessions, grooves are incorporated perpendicularly to the tunnels at their openings to hold the parts of the rope that protrude from the openings, thereby reducing the possibility of ropes rubbing against a user's arms during workouts.

The uniform thickness of the arc-shaped handle emulates the shape and feel of a traditional gymnastics ring. The apparatus may be offered as part of a kit with a pair of handles, webbing, ropes, and G-hooks provided for each handle.

The handle may be provided with a rubber band for holding the webbing together in a folded state against the handle during transport and storage. This rubber band can also be used to store excess webbing, and may be permanently sewn into said webbing for ease of use and to prevent the user from losing it.

Alternatively or additionally, the webbing may be stored by the integration of a hidden pocket or bag in the webbing that can be used for storage and transport of the apparatus.

In a further embodiment, the webbing could be manufactured from eco-friendly materials like organic cotton, thereby promoting sustainability. This inventive apparatus hence introduces a fresh and improved approach to exercising with rings, while ensuring ease of use, portability, comfort, and sustainability.

BRIEF DESCRIPTION OF THE DRAWINGS

Various embodiments of the invention are disclosed in the following detailed description and accompanying drawings.

Figure 1:
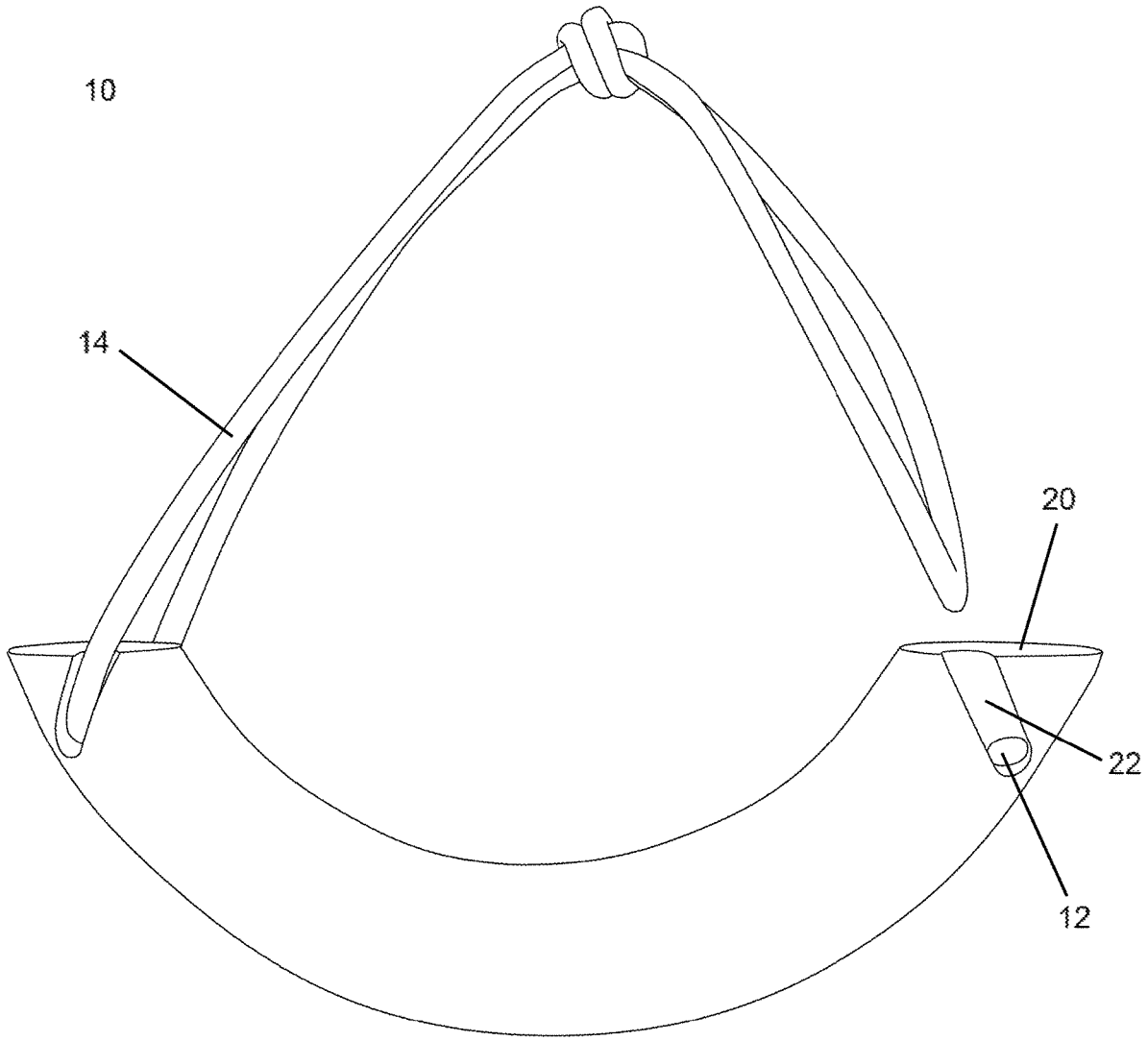
FIG. 1 is a perspective view of the arc-shaped handle apparatus according to one embodiment of the present invention, illustrating the handle with rope looped through tunnels at either end.

The drawings depict embodiments of the present invention for illustrative purposes. It should be understood that the invention is not limited to the precise arrangements and instrumentalities shown in these drawings.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

Definitions

The terminology used herein is for the purpose of describing particular embodiments only and is not intended to be limiting of the invention.

As used herein, the term "and/or" includes any combinations of one or more of the associated listed items.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The terminology used herein is for the purpose of describing particular embodiments only and is not intended to be limiting. As used herein, the singular forms "a," "an" and "the" are intended to include the plural forms as well, unless the context clearly indicates otherwise.

The terms "first," "second," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

Referring now to the drawings, FIG. 1 depicts an embodiment of the arc-shaped exercise handle apparatus, referred to herein as the handle apparatus 10. The handle apparatus 10 has an arc-shaped configuration and comprises a rounded cross-section that forms one third of a traditional gymnastics ring. The handle apparatus 10 has a specific inner radius that matches that of a classic gymnastics ring, ensuring a familiar feel and grip for users accustomed to traditional gymnastics rings. The thickness of the handle apparatus 10 is uniform, further enhancing the user experience by emulating the shape and feel of a traditional gymnastics ring.

The handle apparatus 10 is equipped with two tunnels 12, one on each end of the handle apparatus 10. These tunnels 12 run through the width of the handle apparatus 10 and are designed to receive a rope or strap 14. As illustrated in FIG. 1, the rope 14 can be threaded through these tunnels 12, forming a loop at each end of the handle apparatus 10. The rope 14 serves as the means by which the handle apparatus 10 is suspended from an anchor point (not shown). This design of the handle apparatus 10 significantly reduces the overall weight and size of the apparatus, enhancing its portability and reducing material consumption.

Figure 2:
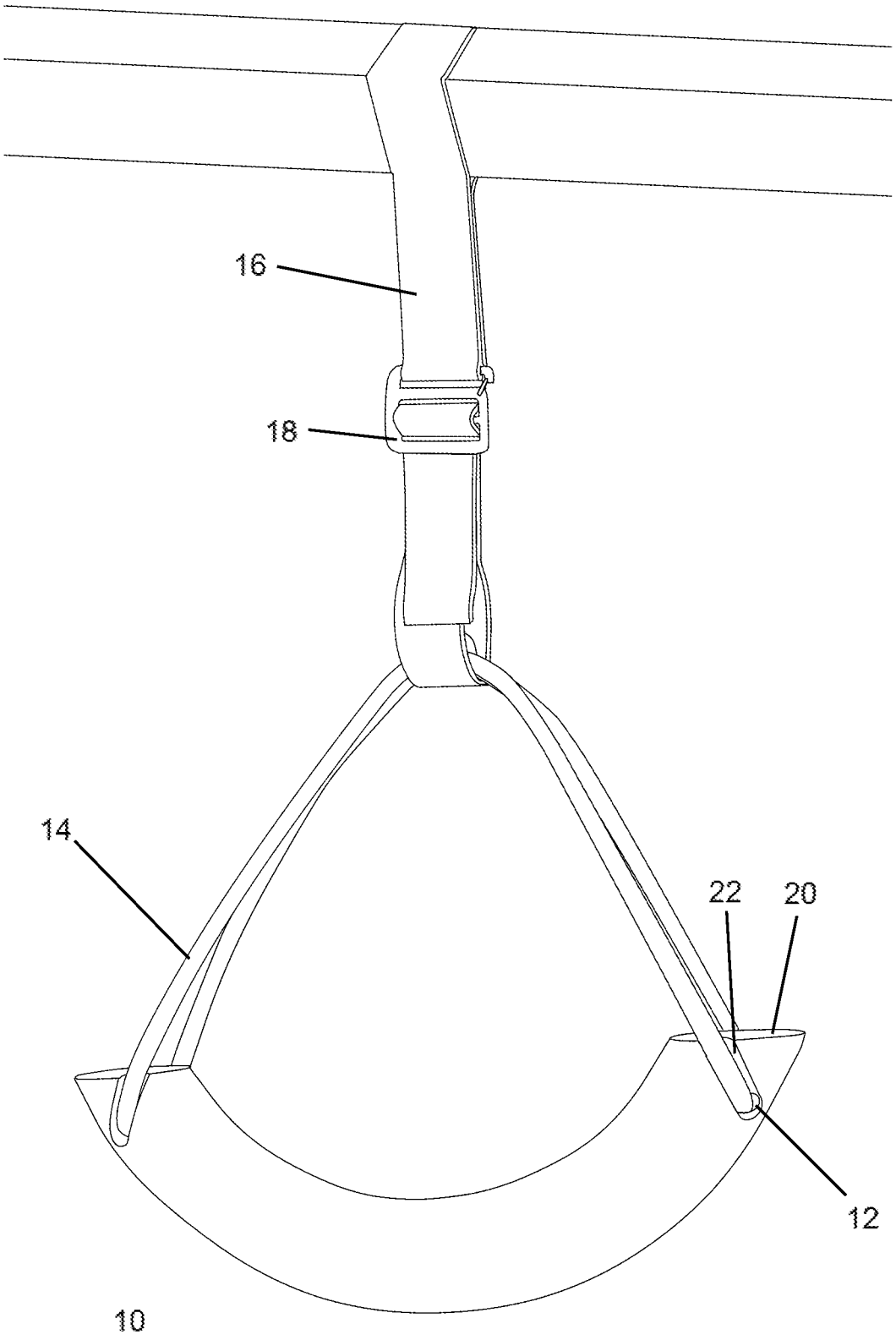
FIG. 2 is a perspective view of the arc-shaped handle apparatus configured with a piece of webbing set at a desired length via a G-hook and looped around an anchor point, in accordance with one embodiment of the present invention.

Turning to FIG. 2, it illustrates how the handle apparatus 10 is connected to an anchor point via a piece of webbing 16. The rope 14, threaded through the tunnels 12, is looped around the webbing 16, which in turn is attached to the anchor point.

Figure 4:
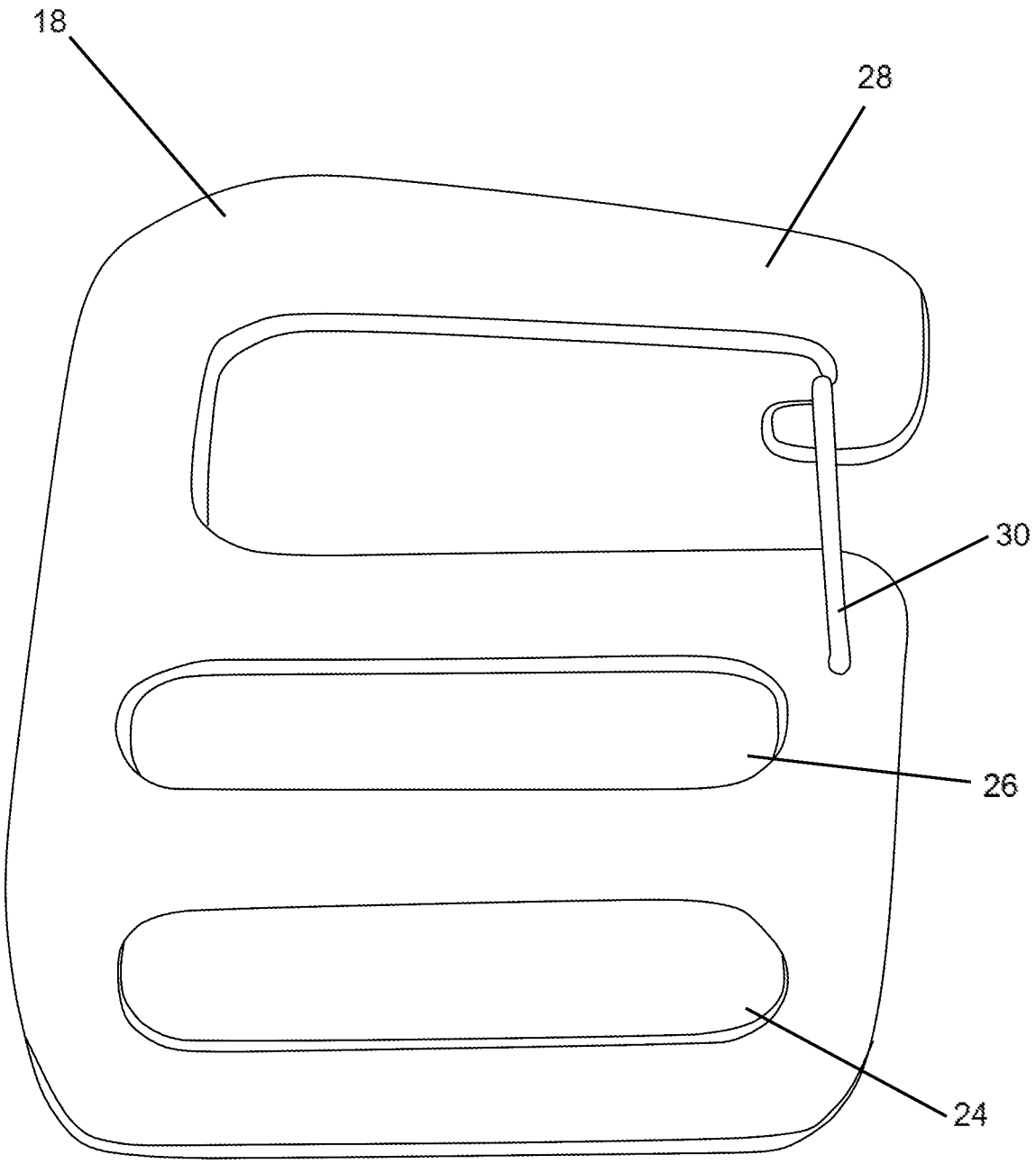
FIG. 4 is a close-up perspective view of a G-hook, highlighting its design and wire gate/clip mechanism for preventing webbing from falling out, in line with an embodiment of the present invention.

The webbing 16 is equipped with a G-hook 18, depicted in detail in FIG. 4, that allows for easy and secure adjustment of the length of the loop formed by the webbing 16. This feature of the G-hook 18 presents a considerable advantage over traditional systems, as it eliminates the need to repeatedly wrap and unwrap the webbing 16, thus saving users valuable time and effort during setup and adjustment phases. In a preferred embodiment of the invention, the ends of the handle apparatus 10 are designed to have parallel flattened surfaces 20. These surfaces 20 allow the handle apparatus 10 to stand stably upright on a surface when placed with both ends down. This feature transforms the handle apparatus 10 into a versatile piece of exercise equipment that can be used as supports during exercise such as push ups, extending the range of exercises that users can perform.

As depicted in FIG. 1, the tunnels 12 that run through either end of the handle apparatus 10 comprise grooves 22 that run perpendicularly to the tunnels 12 at the openings of the tunnels 12. These grooves 22 are shaped to hold the portions of the rope 14 that protrude from the tunnel openings in place, angled away from the curved middle of the handle apparatus 10. This design reduces the likelihood of the ropes abutting against a user's arms when they perform ring exercises while suspended from the handle apparatus 10.

Figure 3:
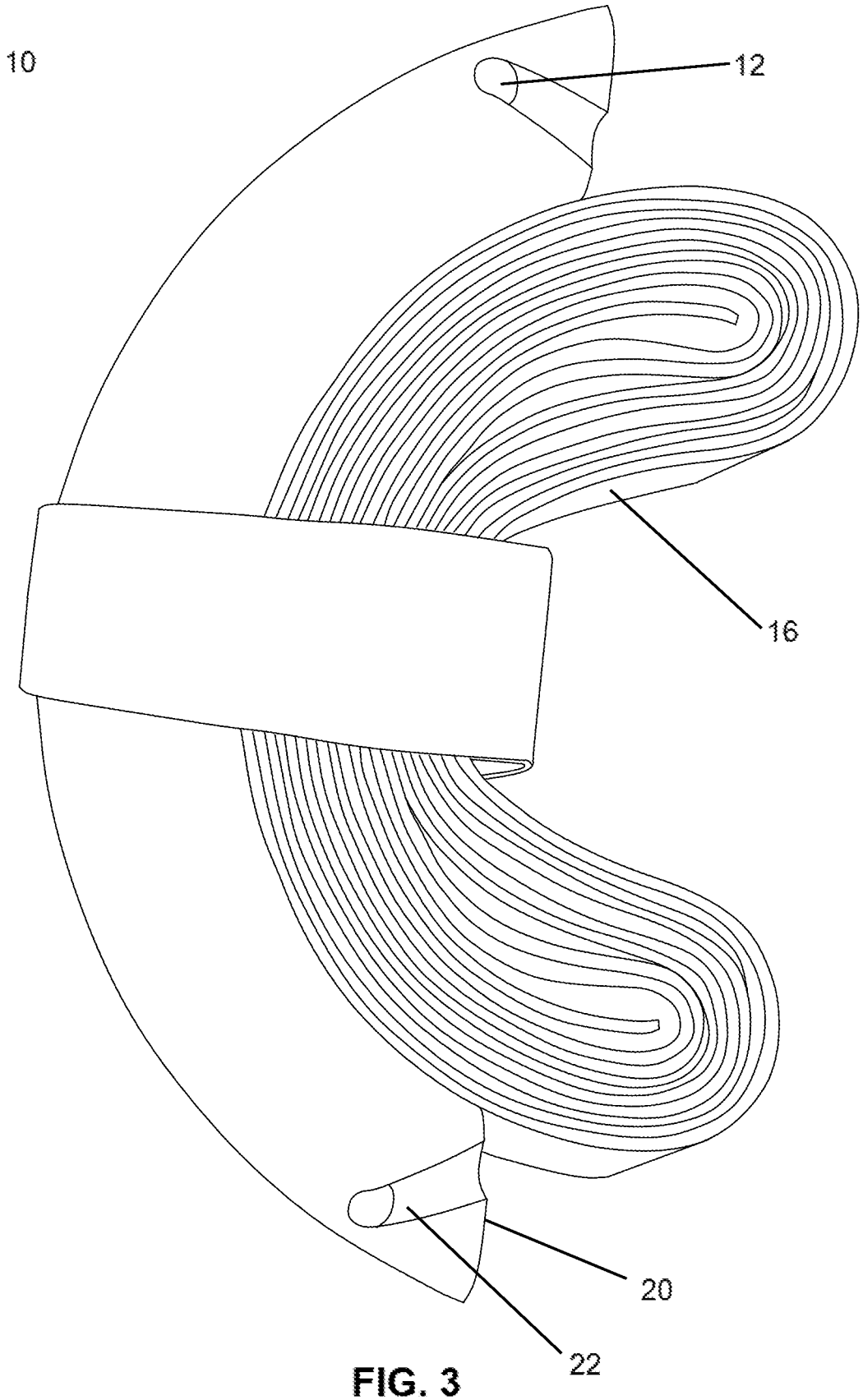
FIG. 3 is a perspective view of the arc-shaped handle apparatus in a storage configuration, demonstrating a piece of webbing folded and tied to the handle for transport and storage.

For ease of transport and storage, the webbing 16 can be folded into a compact shape and tied to the handle apparatus 10, as shown in FIG. 3.

In certain embodiments, the webbing 16 may be held in the position shown in FIG. 3 via a rubber band (not shown) for transport and storage. The rubber band may also be used to tie the straps and rings together when packing, storing and transporting the equipment. This rubber band can also be used to store excess webbing, and may be permanently sewn into said webbing for ease of use and to prevent the user from losing it.

The rubber band may for example be made from pure and natural rubber, making it much more sustainable than existing solutions, which are usually Velcro-based.

Alternatively or additionally, the webbing 16 may include a hidden pocket or bag (not shown) into which the webbing 16 can be easily stuffed when not in use. This feature adds another layer of convenience and portability, and encourages users to maintain an organized workout area.

In line with environmentally friendly practices, the webbing 16 could be manufactured from plastic-free materials such as organic cotton. This novel feature of the invention contributes to sustainability and eco-friendliness, an increasing demand in today's market.

The various features of the handle apparatus 10, such as the tunnels 12, the rope 14, the webbing 16, and the G-hook 18, contribute to its enhanced user experience. The invention's emphasis on user comfort, adaptability, portability, and sustainability, coupled with its straightforward and secure adjustment mechanism, make it a significant improvement over existing systems.

The flattened surfaces 20 at the ends of the handle apparatus 10 not only allow the apparatus to stand upright on a flat surface but also extend its utility to include support-based exercises. The grooves 22 in the tunnels 12 serve to keep the rope 14 in place, ensuring that the rope 14 does not rub against the user's arms during use, significantly enhancing the comfort level during workouts.

Lastly, the innovative design of the G-hook 18, as shown in FIG. 4, has a pair of openings 24 and 26 through which a first portion of webbing is threaded, and a hooked portion 28 onto which a second portion of webbing can be coupled. The opening of the hooked portion 28 is closed with a wire gate or clip mechanism 30, ensures that the webbing 16 stays securely in place, thereby enhancing the safety and convenience of the apparatus. The G-hook 18 is also constructed with a bend in its side profile (not shown in FIG. 4, which shows the frontal profile) in order to introduce friction between the webbing surfaces to prevent them from slipping when weighted.

The G-hook 18 provides a practical and efficient way of adjusting the length of the webbing 16, making it a significant improvement over traditional ring systems. Furthermore, the environmentally friendly design, wherein the webbing 16 is made from organic materials, adds a sustainability factor that is increasingly significant in today's marketplace.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the improved handle apparatus have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An exercise handle apparatus comprising:

a handle being arc-shaped and having a rounded, constant thickness cross-section and a curvature equivalent to one third of a full ring, the handle featuring a tunnel on each of two opposing ends;

a rope or strap insertable through the tunnels and configured to form a loop between each end of the handle;

wherein the handle is adapted to be suspended from an anchor point via the loops formed by the rope or strap and a piece of webbing.

2. The exercise handle apparatus of claim 1, wherein the ends of the handle have parallel flattened surfaces allowing the handle to stand stably upright when placed with both ends on a surface.

3. The exercise handle apparatus of claim 1, wherein the tunnels on each end of the handle feature grooves running perpendicularly to the tunnels, the grooves configured to hold portions of the rope or strap protruding from the tunnels, angling the portions of the rope away from a curved middle of the handle.

4. The exercise handle apparatus of claim 1, wherein a pair of the handles and the rope or strap are provided as part of a kit, the kit further comprising one or more pieces of webbing, and a G-hook for each handle in the pair of handles.

5. The exercise handle apparatus of claim 4, wherein each of the one or more pieces of webbing forms a long strap with a loop on opposing ends thereof and a middle portion of the long strap is configured to be threaded through the one or both G-hooks.

6. The exercise handle apparatus of claim 5, wherein each G-hook comprises a metal object with a pair of openings through which the one or more pieces of webbing can be looped, the metal object further comprising a hooked portion forming a third opening having a gap in a circumference thereof, the third opening allowing for easy insertion and removal of the one or more pieces of webbing, the G-hook also featuring a closeable gate arranged across the gap in the circumference for securing the one or more pieces of webbing within the third opening.

7. The exercise handle apparatus of claim 6, wherein the closeable gate is a clip on a pivot coupled to a frame of the G-hook, the clip moving between a position obstructing the gap in the circumference of the third opening and a position not obstructing the gap in the circumference of the third opening.

8. The exercise handle apparatus of claim 4, wherein the kit further includes one or more rubber bands for securing the one or more pieces of webbing against the corresponding handle in a folded position for transport and storage.

9. The exercise handle apparatus of claim 4, wherein the one or more pieces of webbing can be compactly folded and secured to the corresponding handle for transport and storage.

10. The exercise handle apparatus of claim 9, wherein each piece of webbing includes a hidden pocket or bag for storage of excess webbing or the corresponding entire exercise handle apparatus.

11. The exercise handle apparatus of claim 1, wherein the piece of webbing is constructed from organic cotton.

* * * * *